US010711511B2

(12) United States Patent
Coleman et al.

(10) Patent No.: US 10,711,511 B2
(45) Date of Patent: Jul. 14, 2020

(54) METHODS OF FORMING A LEADING END ASSEMBLY FOR A MOVABLE PARTITION

(71) Applicant: Won-Door Corporation, Salt Lake City, UT (US)

(72) Inventors: William Michael Coleman, Salt Lake City, UT (US); Michael D. George, Kaysville, UT (US); Paul Saccomanno, West Valley City, UT (US)

(73) Assignee: Won-Door Corporation, Salt Lake City, UT (US)

( * ) Notice: Subject to any disclaimer, the term of this patent is extended or adjusted under 35 U.S.C. 154(b) by 144 days.

(21) Appl. No.: 16/003,594

(22) Filed: Jun. 8, 2018

(65) Prior Publication Data

US 2018/0291672 A1 Oct. 11, 2018

Related U.S. Application Data

(60) Division of application No. 14/635,757, filed on Mar. 2, 2015, now Pat. No. 10,017,974, which is a (Continued)

(51) Int. Cl.
*E06B 3/48* (2006.01)
*E06B 3/46* (2006.01)
(Continued)

(52) U.S. Cl.
CPC ..... *E06B 3/481* (2013.01); *E05D 15/26* (2013.01); *E06B 1/60* (2013.01); *E06B 3/4654* (2013.01);
(Continued)

(58) Field of Classification Search
CPC ..... E06B 1/60; E06B 3/4654; E06B 3/481; E06B 9/0692; E06B 3/94; E05D 15/26;
(Continued)

(56) References Cited

U.S. PATENT DOCUMENTS 1,749,191 A * 3/1930 Nordell ..... E06B 3/94 160/84.09
2,717,064 A 9/1955 Hock
(Continued)

FOREIGN PATENT DOCUMENTS

JP 2007-321421 A 12/2007
WO 2005/098189 A1 10/2005
WO 2010/089570 A1 8/2010

OTHER PUBLICATIONS

PCT International Search Report and Written Opinion of the International Searching Authority for PCT/US2013/030248, dated May 29, 2013, 8 pages.

*Primary Examiner* — Katherine W Mitchell
*Assistant Examiner* — Abe Massad
(74) *Attorney, Agent, or Firm* — TraskBritt

(57) ABSTRACT

A leading end assembly for a movable partition may include a frame, an exterior skin coupled to the frame for covering a leading surface and two opposing side surfaces of the frame, the exterior skin including a leading member forming at least a portion of a leading surface of the leading end assembly and at least two side members, each side member being formed separately from the leading member and forming at least a portion of a lateral side portion of the leading end assembly. Movable partitions may include leading end assemblies and leading end assemblies may be formed by related methods.

20 Claims, 6 Drawing Sheets

Related U.S. Application Data continuation of application No. 13/422,209, filed on Mar. 16, 2012, now Pat. No. 8,967,225.

(51) Int. Cl.

| | |
|---|---|
| ***E05D 15/26*** | (2006.01) |
| ***E06B 1/60*** | (2006.01) |
| *E05F 15/635* | (2015.01) |
| *E05F 15/643* | (2015.01) |

(52) U.S. Cl.
CPC ..... *E05F 15/635* (2015.01); *E05F 15/643* (2015.01); *E05Y 2201/43* (2013.01); *E05Y 2600/46* (2013.01); *E05Y 2900/142* (2013.01); *Y10T 29/49826* (2015.01)

(58) Field of Classification Search
CPC . E05D 2015/268; E05F 15/635; E05F 15/643
See application file for complete search history.

(56) References Cited

U.S. PATENT DOCUMENTS 2,915,115 A 12/1959 Reynolds
3,094,199 A 6/1963 Wallmann
3,223,147 A * 12/1965 Holloway ..... E06B 3/94 160/84.09
3,289,741 A 12/1966 Gossling
3,325,941 A 6/1967 Prucha
3,348,628 A 10/1967 Dixon et al.
3,414,040 A 12/1968 Harris
3,447,584 A 6/1969 Smart
3,481,388 A 12/1969 Smart
3,509,934 A 5/1970 Smart
3,577,679 A 5/1971 Petterborg
3,599,702 A 8/1971 Bedard
3,720,254 A 3/1973 Smart
3,799,237 A 3/1974 Proserpi
3,807,480 A 4/1974 Smart
4,133,364 A 1/1979 Smart
4,189,173 A 2/1980 Rester
4,228,841 A 10/1980 Dixon
4,303,286 A 12/1981 McClellan
4,658,878 A 4/1987 Williams
4,763,712 A 8/1988 Van Der Klaauw
4,834,161 A 5/1989 Johnson et al.
4,867,221 A 9/1989 Dixon et al.
4,924,929 A 5/1990 Johnson et al.
4,957,600 A 9/1990 Carlson et al.
5,279,436 A 1/1994 Elliott et al.
RE34,665 E 7/1994 Strand
5,351,737 A * 10/1994 Hoshiyama ..... E06B 9/262 160/84.03
5,456,303 A 10/1995 Horinouchi
5,625,266 A 4/1997 Stark
5,638,639 A 6/1997 Goodman et al.
5,816,309 A 10/1998 Paradise
5,950,373 A 9/1999 Von et al.
5,960,157 A 9/1999 McGraw
6,152,205 A * 11/2000 Toti ..... E06B 9/262 160/84.04
6,209,171 B1 4/2001 Pelletier et al.
6,296,038 B1 10/2001 Chen
6,438,912 B1 8/2002 Avent
6,581,345 B2 6/2003 Goldsmith et al.
6,615,894 B1 9/2003 McKeon
6,662,848 B2 12/2003 Goodman et al.
6,793,299 B2 9/2004 Newberry et al.
6,935,662 B1 8/2005 Hauber et al.
6,978,820 B2 12/2005 Aoki
7,066,297 B2 6/2006 Goodman et al.
7,308,973 B2 12/2007 Dziwak
7,353,637 B2 4/2008 Harger et al.
7,448,426 B2 11/2008 Hsieh
7,478,663 B2 1/2009 Goodman et al.
7,513,293 B2 4/2009 Goodman et al.
7,673,666 B2 3/2010 Fan
7,730,926 B2 6/2010 Moriya et al.
7,845,386 B2 12/2010 Coleman et al.
7,886,804 B2 2/2011 Goodman et al.
8,100,164 B2 1/2012 Goodman et al.
8,448,687 B2 5/2013 Saccomanno
8,544,524 B2 10/2013 Goodman et al.
8,763,672 B2 7/2014 Smart et al.
8,925,614 B2 * 1/2015 Okachi ..... E06B 9/54 160/31
2003/0155081 A1 8/2003 Goodman et al.
2003/0226645 A1 12/2003 Toti
2004/0194386 A1 10/2004 Albiero
2006/0076783 A1 4/2006 Tsai
2006/0144529 A1 7/2006 Hemphill
2007/0029053 A1 2/2007 Moriya et al.
2007/0095488 A1 5/2007 Huang
2008/0006594 A1 1/2008 Layton
2008/0105387 A1 5/2008 Coleman et al.
2008/0105389 A1 5/2008 Goodman et al.
2008/0115896 A1 5/2008 Goodman
2008/0169069 A1 7/2008 Coleman et al.
2008/0197808 A1 8/2008 Banta et al.
2008/0244991 A1 10/2008 Coleman et al.
2009/0044918 A1 2/2009 Goodman et al.
2009/0188633 A1 7/2009 Goodman et al.
2011/0000625 A1 1/2011 George
2011/0036016 A1 2/2011 Knight et al.
2011/0088322 A1 4/2011 Coleman et al.
2011/0247275 A1 10/2011 Coleman et al.
2012/0042573 A1 2/2012 Knight et al.
2012/0325412 A1 12/2012 Goodman et al.

* cited by examiner

METHODS OF FORMING A LEADING END ASSEMBLY FOR A MOVABLE PARTITION

CROSS-REFERENCE TO RELATED APPLICATIONS

This application is a divisional of U.S. patent application Ser. No. 14/635,757, filed Mar. 2, 2015, pending, which is a continuation of U.S. patent application Ser. No. 13/422,209, filed Mar. 16, 2012, now U.S. Pat. No. 8,967,225, issued Mar. 3, 2015, the disclosure of each of which is incorporated herein in its entirety by this reference.

The subject matter of this application is related to the subject matter of U.S. patent application Ser. No. 12/859,126, filed Aug. 18, 2010, now U.S. Pat. No. 8,627,618, issued Jan. 14, 2014 and entitled "Closure Assemblies for Movable Partitions, Movable Partition Systems including Closure Assemblies and Related Methods," and to the subject matter of U.S. patent application Ser. No. 13/169,299, filed Jun. 27, 2011, now U.S. Pat. No. 8,763,672, issued Jul. 1, 2014 and entitled "Methods, Apparatuses, and Systems for Driving a Movable Partition with a Lead Drive Box," the disclosure of each of which is incorporated herein in its entirety by this reference.

TECHNICAL FIELD

Embodiments of the present disclosure are directed to leading end assemblies for movable partitions, movable partition assemblies including leading end assemblies, and methods of forming leading end assemblies for movable partitions.

BACKGROUND

Movable partitions are utilized in numerous situations and environments for a variety of purposes. Such partitions may include, for example, a movable partition including foldable or collapsible doors configured to enclose or subdivide a room or other area. Often, such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event such as the actuation of an associated alarm. For example, one or more accordion or similar folding-type partitions may be used as a security barrier, a fire barrier, or both a security barrier and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along an overhead track, which is often located above the movable partition in a header assembly, until the partition extends a desired distance across the room.

When deployed, a leading end of the movable partition, often defined by a component known as a lead post, complementarily engages a receptacle in a fixed structure, such as a wall, or in a mating receptacle of another door. Such a receptacle may be referred to as a jamb or a door post when formed in a fixed structure, or as a mating lead post when formed in another movable partition. It is desirable that the lead post be substantially aligned with the mating receptacle such that the movable partition may be completely closed and an appropriate seal formed between the movable partition and the mating receptacle.

BRIEF SUMMARY

In accordance with some embodiments of the present disclosure, a leading end assembly for a movable partition may include a frame and an exterior skin coupled to the frame for covering a leading surface and two opposing side surfaces of the frame. The exterior skin may include a leading member forming at least a portion of a leading surface of the leading end assembly, and at least two side members, each side member of the at least two side members being formed separately from the leading member and forming at least a portion of a lateral side portion of the leading end assembly.

In some embodiments, the frame and the exterior skin may form a volume within the leading end assembly, and at least a portion of a trolley assembly may be disposed within the volume. In some embodiments, at least a portion of a drive assembly may also be disposed within the volume.

In some embodiments, each side member of the at least two side members may be coupled to the frame and the leading member. Each side member of the at least two side members may include a first portion configured to couple with at least one of the leading member and the frame, and a second portion configured to couple with a portion of a plurality of panels of a movable partition.

In some embodiments, the at least two side members may further include at least two extension members, and each extension member of the at least two extension members may be coupled to at least one of a side member of the at least two side members and to the frame. The leading member, the at least two side members, and the at least two extension members may cooperatively form a volume within the leading end assembly, and at least a portion of a drive assembly and at least a portion of a trolley assembly may be disposed within the volume. Each extension member of the at least two extension members may include a first portion configured to couple with at least one of the at least two side members and the frame and a second portion configured to couple with a portion of a plurality of panels of a movable partition. The leading end assembly may further include at least one structural support coupled to the frame and to each extension member of the at least two extension members. In some embodiments, the leading end assembly may include at least one of a transparent panel and an emergency actuator coupled to at least one extension member of the at least two extension members.

In some embodiments, each side member of the at least two side members may include a mounting area configured to attach to a side surface the frame, a transition area, and a trailing portion configured to attach to folding panels of a movable partition. At least a portion of the transition area may extend substantially inward from the side surface of the frame toward a center portion of the frame. In some embodiments, at least another portion of the transition area may extend substantially in a direction normal to the trailing surface of the frame.

In accordance with additional embodiments of the present disclosure, a leading end assembly for a movable partition may include a frame and an exterior skin coupled to the frame for covering a leading surface and two opposing side surfaces of the frame. The exterior skin may include a leading member forming at least a portion of a leading surface of the leading end assembly, and may also include at least two side members, each side member of the at least two side members being formed separately from the leading member and forming at least a portion of a lateral side portion of the leading end assembly. Each side member may include a support bracket coupled to the frame, and an extension member coupled to at least one of the support bracket and the frame, the support bracket and the extension member each being configured to couple with an accordion-style structure of panels of a movable partition.

In some embodiments, each side member of the at least two side members may include a portion configured to couple to at least one of the leading member and the frame. Each side member may also include a transition area with a portion that extends substantially inward from the side surface of the frame toward a center portion of the frame. Each side member may also include a transition area with a portion that extends substantially in a direction normal to the trailing surface of the frame. Each extension member may further include a portion at least partially defining a lateral side portion of the leading end assembly.

In yet additional embodiments of the present disclosure, a movable partition may include a plurality of hingedly coupled panels movably coupled to a track, and a leading end assembly attached to a leading end of the hingedly coupled panels. The leading end assembly may include a frame and an exterior skin coupled to the frame for covering a leading surface and two opposing side surfaces of the frame. The exterior skin may include a leading member forming at least a portion of a leading surface of the leading end assembly and at least two side members, each side member being formed separately from the leading member and forming at least a portion of a lateral side portion of the leading end assembly.

In yet additional embodiments of the present disclosure, a method of forming a leading end assembly for a movable partition includes forming a frame member, coupling a leading member to the frame member, coupling two opposing side members to the frame member, forming a portion of each of the two opposing side members for coupling with a leading panel of a sheet of panels of a movable partition, coupling two opposing extension members extending from the two opposing side members to the frame member, and forming a portion of each of the two opposing extension members for coupling with a leading panel of a sheet of panels of a movable partition.

BRIEF DESCRIPTION OF THE DRAWINGS

While the specification concludes with claims particularly pointing out and distinctly claiming that which are regarded as embodiments of the present disclosure, the advantages of embodiments of the disclosure may be more readily ascertained from the description of embodiments of the disclosure when read in conjunction with the accompanying drawings, in which:

DETAILED DESCRIPTION

Illustrations presented herein are not meant to be actual views of any particular device or system, but are merely idealized representations that are employed to describe embodiments of the present disclosure. Additionally, elements common between figures may retain the same numerical designation.

As described in above-referenced U.S. Pat. No. 8,627,618, movable partitions may include a substantially flat leading end assembly that is configured to cover at least a portion of a pocket, in which the movable partition is stored, in a retracted state and configured to engage with an adjoining structure when the movable partition is in an expanded state. As described in above-referenced U.S. Pat. No. 8,627,618, movable partitions may also include a drive motor (i.e., a motor that drives the movable partition between expanded and retracted states) positioned on the movable partition proximate to the leading end assembly, for example, in a lead drive box formed by the leading end assembly. In view of these two patent applications, it can be seen that including a drive motor mounted to the movable partition requires different structure configurations of the leading end assembly. Accordingly, as discussed below in greater detail, a leading end assembly is provided that is adaptable (e.g., modular) that may be configured according to the requirements of a particular movable partition system (e.g., to accommodate systems with or without a drive motor mounted to the movable partition).

Figure 1:
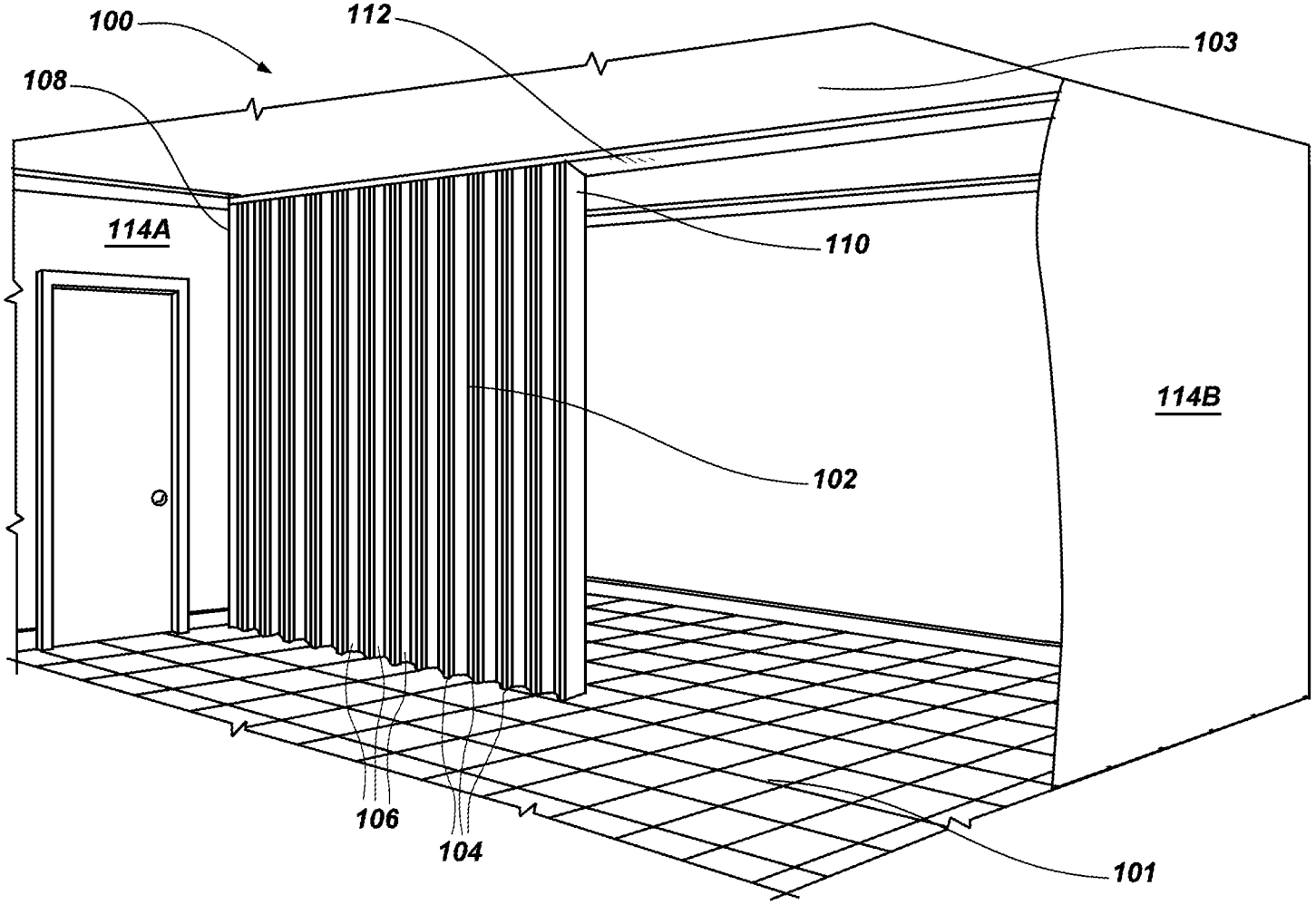
FIG. 1 is a perspective view of a system including a movable partition in accordance with an embodiment of the present disclosure.

Referring to FIG. 1, a system 100 is shown, which may also be referred to as a movable partition system 100, including a movable partition 102 in the form of an accordion-type door. The movable partition 102 may be used as a barrier (e.g., a security barrier, a fire barrier, or both a security barrier and a fire barrier). In other embodiments, the movable partition 102 may be used, for example, to subdivide a relatively larger space into relatively smaller spaces (e.g., rooms or areas). The movable partition 102 may be formed with a plurality of panels 106 that are connected to one another with hinges or other hinge-like members 104 to form a pleated (i.e., a plicated) structure. The movable partition 102 is engaged with (e.g., suspended from) an overhead track 112 along which the movable partition 102 moves as the movable partition 102 is extended (i.e., closed) and retracted (i.e., opened). The hinged connection of the panels 106 allows the movable partition 102 to be compactly stored in a movable partition storage area such as, for example, a storage pocket 108 formed in a wall 114A of a building when in a retracted or folded state.

To deploy the movable partition 102 to an extended position, the movable partition 102 is moved along the overhead track 112 to an adjoining structure positioned at an end portion of the overhead track 112. A leading end structure of the movable partition 102 may include a leading end assembly 110 configured to engage with an adjoining structure such as, for example, an opposing wall 114B, a doorjamb, or a leading end assembly of another movable partition (not shown). In some embodiments, the leading end assembly 110 may be similar to the leading end assemblies described in, for example, U.S. patent application Ser. No. 12/497,310, which was filed Jul. 2, 2009 and entitled "Movable Partitions, Leading End Assemblies for Movable Partitions and Related Methods," which is assigned to the assignee hereof and the disclosure of which is incorporated herein in its entirety by this reference. While the embodiment of the movable partition 102 shown and described with reference to FIG. 1 contains a single accordion-type door, additional embodiments may include multiple doors. For example, a partition may include two doors (e.g., accordion-type doors) configured to extend across a space and join together to partition a space.

Figure 2:
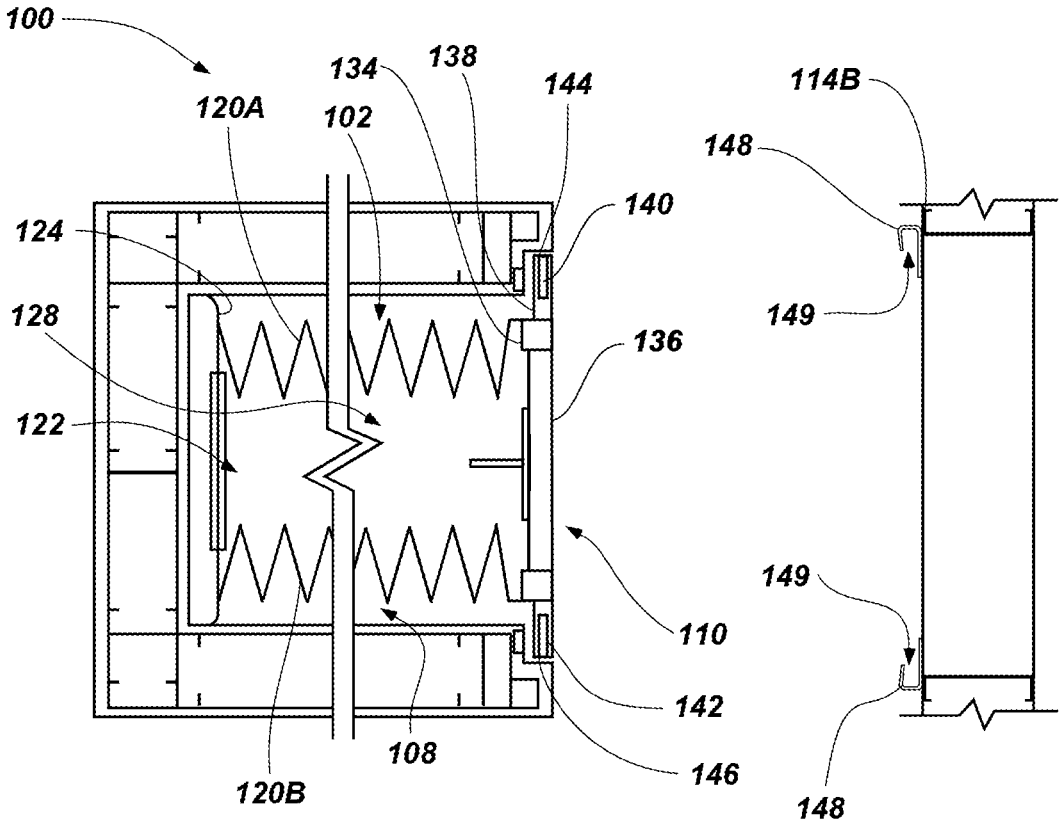
FIG. 2 is a partial cross-sectional view of a movable partition in accordance with an embodiment of the present disclosure.

Referring to FIG. 2, the movable partition system 100 is shown in a partial cross-sectional view in a retracted state. As shown in FIG. 2, a movable partition system 100 may include an accordion-style movable partition 102 that may include a first accordion-style structure 120A and a second accordion-style structure 120B that is laterally spaced from, and extends generally parallel to, the first structure 120A. Each of the two structures 120A and 120B has a trailing end 122 structurally fixed to a jamb such as, for example, a floating jamb 124 that is movable within the pocket 108, and a leading end 128 that is attached to the leading end assembly 110.

When the movable partition 102 is in a retracted state, the movable partition 102 may be stored in the pocket 108 formed by one or more walls. For example, as shown in FIG. 2, the pocket 108 may be provided by one or more walls extending substantially parallel to each other and extending between a floor 101 and a ceiling 103 (FIG. 1). The leading end assembly 110 may include a leading portion such as, for example, a leading surface 136 that may be positioned adjacent to (e.g., in abutment with) an adjoining structure such as, for example, an opposing wall 114B or the leading end assembly of another movable partition (not shown). As used herein, "leading surface" means a distal surface of the leading end assembly 110 (e.g. the surface of an element located furthest from the point of attachment with the movable partition 102). The leading end assembly 110 may further include a trailing portion such as, for example, a trailing surface 138 positioned opposite the leading surface 136. As used herein, "trailing surface" means a proximal surface of the leading end assembly 110 (e.g. the surface of an element located at the point of attachment with the movable partition 102).

The leading end assembly 110 may include an attachment portion configured to attach to the movable partition 102. For example, the movable partition 102 may be coupled to an attachment portion of the leading end assembly 110 such as, for example, the trailing surface 138 of the leading end assembly 110. In some embodiments, the attachment portion of the leading end assembly 110 may include one or more frame members 134 for coupling the movable partition 102 to the leading end assembly 110. The frame members 134 may be formed in any shape suitable to attach the accordion-style structures 120A, 120B such as, for example, a member having rectangular shape as shown in FIG. 2 that extend vertically along the leading end assembly 110. As used herein, the term "vertical" references a vertical direction of the leading end assembly 110 as it is installed in a movable partition system 100 (i.e., vertically between the floor 101 and the ceiling 103 shown in FIG. 1). An end of the movable partition 102 (e.g., the leading end 128 of the partitions 120A, 120B) may be coupled to the leading end assembly 110. For example, the movable partition 102 may be coupled to the leading end assembly 110 at the frame members 134 on the trailing surface 138. The movable partition 102 may be coupled to the leading end assembly 110 in any suitable manner including, but not limited to, using adhesives, tongue and groove joints, and fasteners (e.g., screws, bolts, rivets, etc.). The leading end assembly 110 may also be coupled to a trolley (not shown) movably coupled to the overhead track 112 of the movable partition system 100 (FIG. 1). In some embodiments, an upper portion (i.e., a portion of the leading end assembly 110 proximate to the overhead track 112 (FIG. 1)) may be coupled to the trolley.

As further shown in FIG. 2, the leading end assembly 110 may be sized to form a barrier at an open end of the pocket 108 of FIG. 1 (e.g., the end of the pocket 108 through which the movable partition 102 may be extended along the overhead track) when the movable partition 102 is in a retracted state. In some embodiments, the leading end assembly 110 may form a barrier substantially covering the open end of the pocket 108. In some embodiments, the leading surface 136 of the leading end assembly 110 may be substantially flush with a portion of the pocket 108 (e.g., the walls forming the pocket 108) when the movable partition 102 is retracted in a storage position within the pocket 108. In some embodiments, the leading surface 136 may be substantially flat and may be positioned adjacent to the opposing wall 114B. In other embodiments, the opposing wall 114B may include a door jamb set into the opposing wall 114B.

Referring still to FIG. 2, the leading end assembly 110 may include a closure assembly to secure the leading end assembly 110 with a portion of the opposing wall 114B. In some embodiments, the closure assembly may secure or otherwise retain the leading end assembly 110 in engagement with the opposing wall 114B upon reaching a predetermined temperature, which may prevent the severe heat from a fire from causing the leading end assembly 110 and the opposing wall 114B to separate, such as due to warping. The closure assembly may include a first latching member 140 and a second latching member 142 positioned on the leading end assembly 110. In some embodiments, the first latching member 140 may be positioned on a first side 144 of the leading end assembly 110 and the second latching member 142 may be positioned on a second side 146 of the leading end assembly 110 that opposes the first side 144 of the leading end assembly 110. In some embodiments, the first and second latching members 140, 142 may be at least partially retained within a portion of the leading end assembly 110 in a retracted position. The opposing wall 114B may include a closure assembly such as, for example, a receiving assembly including one or more strike moldings 148 having one or more openings 149 formed by or in the strike moldings 148 to receive portions of the first and second latching members 140, 142. The strike moldings 148 may be coupled to a portion of the opposing wall 114B and positioned to have a lateral width greater than that of the leading end assembly 110 to enable the leading end assembly 110 to be positioned adjacent to the opposing wall 114B between the strike moldings 148. It is noted that while the embodiment of FIG. 2 illustrates the strike moldings 148 having a substantially J-shaped cross section, the strike moldings 148 may be formed in any suitable shape enabling the strike moldings 148 to receive a portion of first and second latching members 140, 142.

Figure 3:
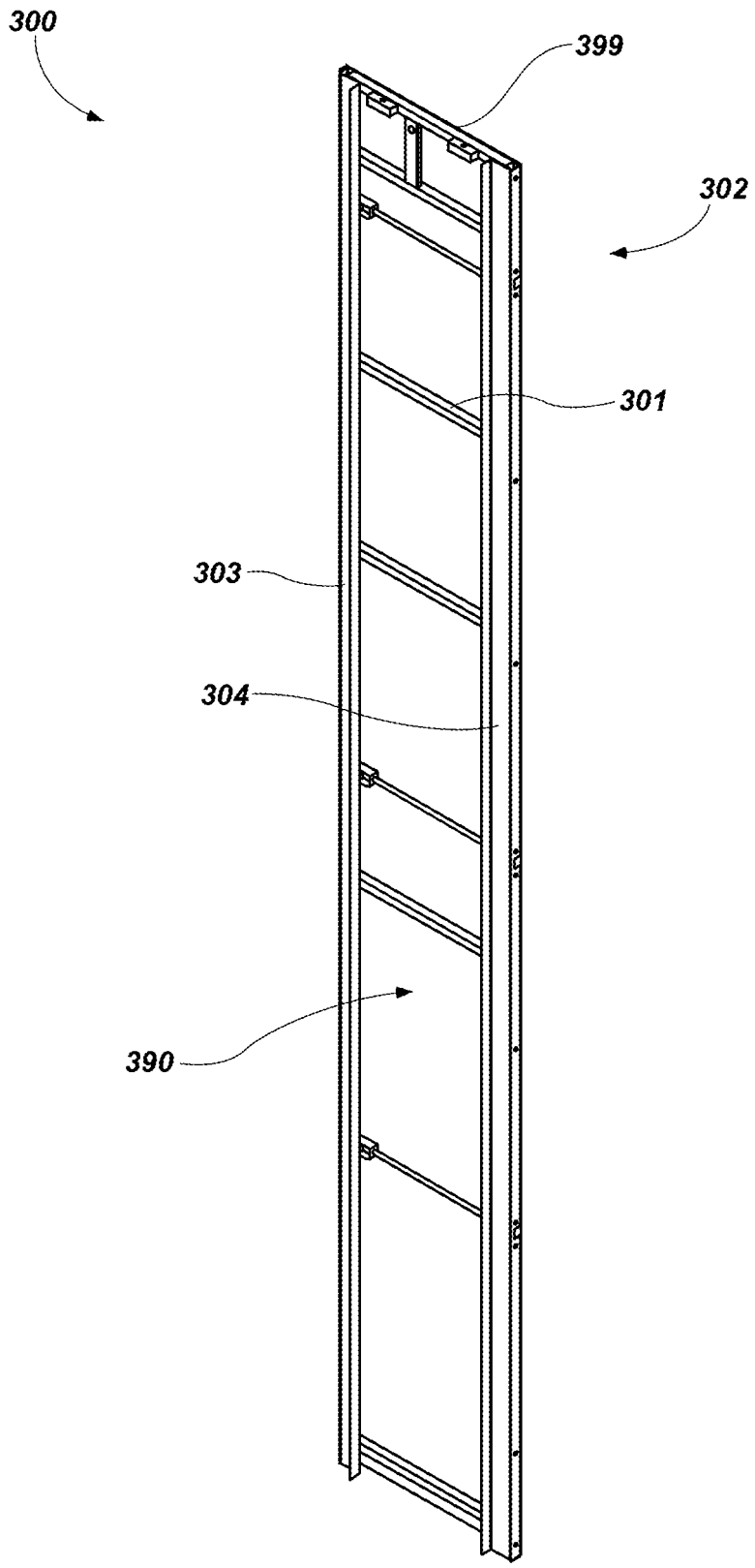
FIG. 3 is a perspective view of a leading end assembly in accordance with an embodiment of the present disclosure adapted for use in a movable partition system.

Referring now to FIG. 3, an embodiment of a leading end assembly 300 is shown adapted for use in a movable partition system that does not include a drive motor mounted on the movable partition or the leading end assembly. The leading end assembly 300 may include a frame 301 and an exterior skin 302. In some embodiments, the leading end assembly 300 may be somewhat similar to the leading end assembly 110 discussed above with reference to FIGS. 1 and 2. The leading end assembly 300 may include members directly or indirectly coupled to the frame 301. For example, a leading member 399, a first side member 303, and a second side member 304 may be directly or indirectly coupled to the frame 301. The leading member 399 and the first and second side members 303 and 304 may together form the exterior skin 302.

The frame 301 and exterior skin 302 may be configured to form at least a partial enclosure with a volume 390 within the leading end assembly 300. For example, the leading member 399 and first and second side members 303 and 304 may define three sides of the volume 390.

The leading member 399 and the first and second side members 303 and 304 may be formed from sheet metal such as steel, stainless steel, aluminum, or other metals or metal alloys, or may be formed from polymers or other suitable materials.

The leading member 399 and side members 303 and 304 may be coupled to the frame 301 by mechanical fasteners such as bolts, rivets, screws, or clips, or may be coupled to the frame by adhesives, welding, or other methods. In some embodiments, the leading member 399 may be coupled to at least one of the frame 301 and the side members 303 and 304, and the side members 303 and 304 may be coupled to at least one of the frame 301 and the leading member 399. The leading member 399 may form an exterior leading surface 136 (shown in FIG. 2) of the leading end assembly 300.

Figure 4:
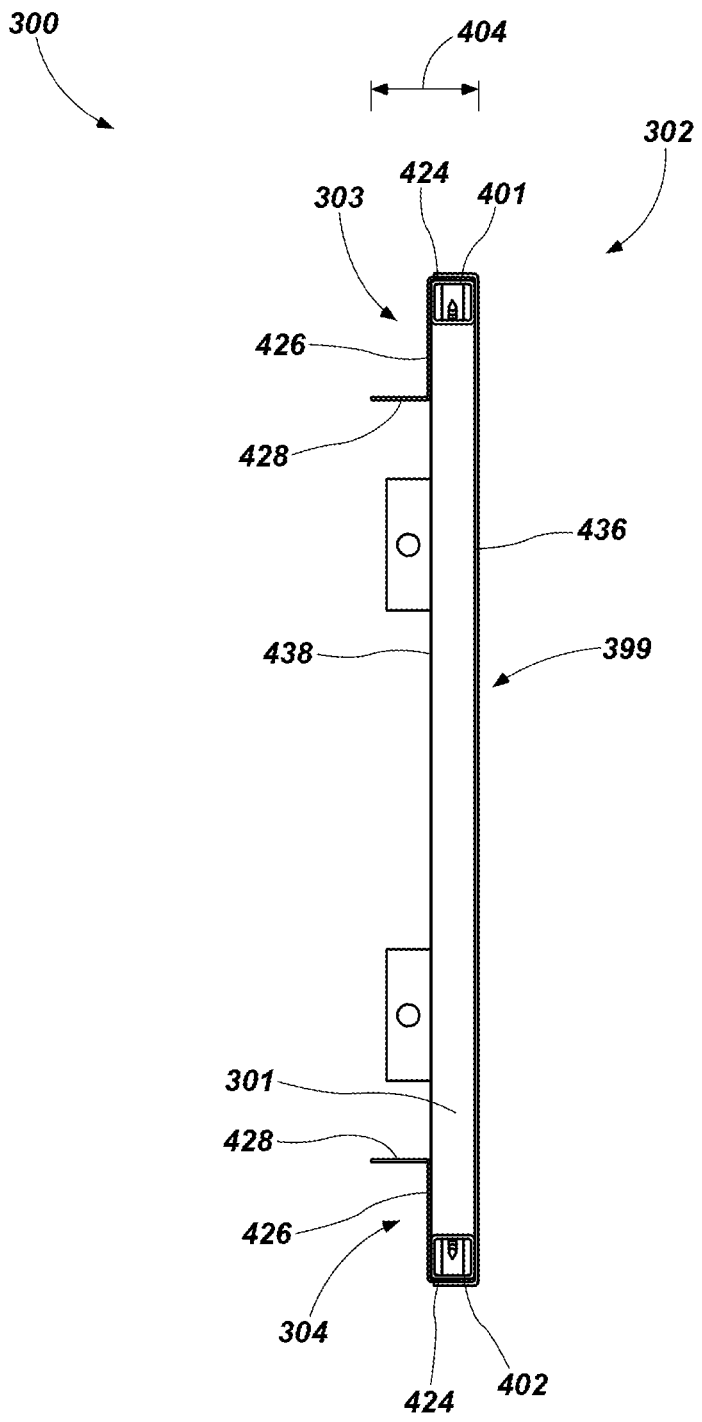
FIG. 4 is a partial, overhead cross-sectional view of the leading end assembly of FIG. 3.

Referring now to FIG. 4, a leading end assembly 300 of the embodiment described above in relation to FIG. 3 is shown in a partial, overhead cross-sectional view. The leading end assembly 300 may include a frame 301 with a leading surface 436, two opposing side surfaces 401 and 402, and a trailing surface 438. The leading surface 436 and opposing side surfaces 401 and 402 of the frame 301 may be substantially covered by an exterior skin 302. As above, the exterior skin 302 may include the leading member 399 and the first and second side members 303 and 304.

The first and second side members 303 and 304 or portions thereof may be formed as a bracket (e.g., an L-shaped bracket, a Z-shaped bracket). For example, each of the first and second side members 303 and 304 may include a first portion 424, a transition area 426, and a second portion 428. The first portion 424 may be configured to couple to the frame 301 by any suitable attachment method (e.g., as previously listed in relation to FIG. 3). The first portion 424 may comprise a mounting area. The transition area 426 may extend from the first portion (or mounting area) 424 to the second portion 428, and may be substantially parallel to the trailing surface 438 of the frame 301. In additional embodiments, the transition areas 426 or portions of the transition areas 426 may extend away from the trailing surface 438 (i.e., extend in a direction substantially normal to the trailing surface 438). The first portion 424, the transition area 426, and the second portion 428 may together form at least a portion of a lateral side portion 404 of the leading end assembly 300.

The first portion 424 of the side members 303 and 304 may be configured to couple with the side surfaces 401 and 402 of the frame 301, the trailing surface 438 of the frame 301, or both. In some embodiments, the transition areas 426 of the side members 303 and 304 may be coupled to the side surfaces 401 and 402 or the trailing surface 438 of the frame 301.

Portions of the side members 303 and 304 and portions of the leading member 399 may overlap when assembled (e.g., as shown in FIG. 4). For example, the leading member 399 may be formed with a U-shaped cross-section that may at least partially overlap first portions 424 of the side members 303 and 304 at or near the side surfaces 401 and 402 of the frame 301.

As discussed above, a portion of the leading end assembly 300 may be configured to couple with the accordion-style structures 120A and 120B of the movable partition 102 (FIG. 2). For example, the second portion 428 (e.g., a trailing portion) of the side members 303 and 304 may be configured to attach to leading ends 128 of accordion-style structures 120A and 120B by adhesive bonding, mechanical fasteners such as rivets, bolts, screws, or clips, or by other methods.

Figure 5:
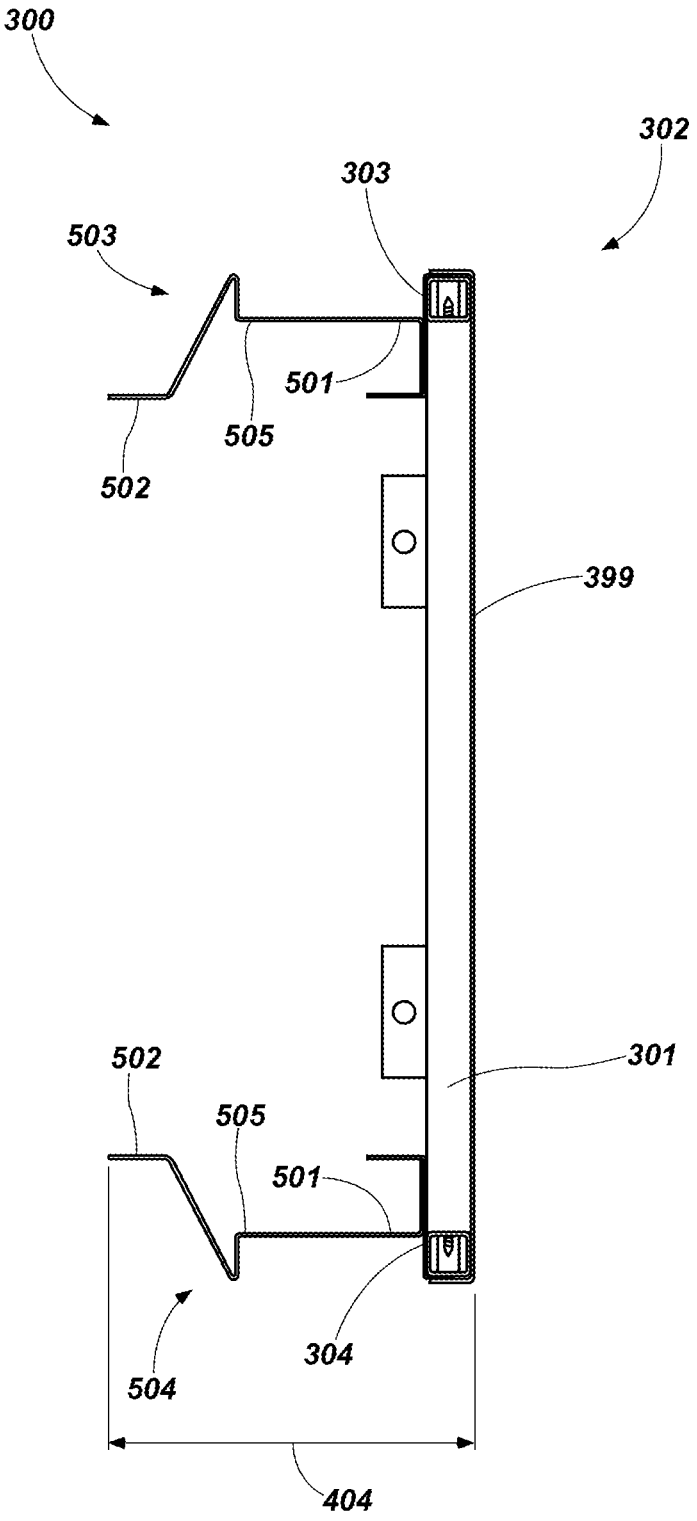
FIG. 5 is a partial, overhead cross-sectional view of the leading end assembly of FIG. 3 adapted for use in another movable partition system.

Referring now to FIG. 5, the leading end assembly 300 is shown adapted for use in another movable partition system (e.g., a system that includes a drive motor 320 mounted on the movable partition or the leading end assembly). For example, each of the side members 303 and 304 of the leading end assembly 300 may include extension members 503 and 504, respectively. Extension members 503 and 504 may be coupled to the side members 303 and 304, the frame 301, or both. Each of extension members 503 and 504 may include a first portion 501 configured to couple with at least one the frame 301 and the side members 303 and 304. For example, the first portion 501 of each of the extension members 503 and 504 may be configured to couple with a portion of the side members 303 and 304 (e.g., the transition areas 426).

The extension members 503 and 504 may at least partially define a lateral side portion 404 of the leading end assembly 300. Each of the extension members 503 and 504 may also include a second portion 502 configured to couple with the accordion-style structures 120A and 120B of the movable partition 102 (FIG. 2). Side members 303 and 304 and extension members 503 and 504 may be formed separately, or may be formed integrally (i.e., formed as a single piece).

Each of the extension members 503 and 504 may further include a transition area 505 intermediate the first portion 501 and the second portion 502. The transition areas 505 may include portions that extend at least partially in a direction substantially normal to the trailing surface 438 of the frame 301 (FIG. 4). The transition areas 505 may also include portions that extend at least partially in a direction substantially parallel to the trailing surface 438 of the frame 301.

The frame 301, the leading member 399, the side members 303 and 304, and the extension members 503 and 504 may together form an adaptable (e.g., modular) leading end assembly that may be configured according to the requirements of a particular movable partition system. For example, in the embodiment shown in FIG. 4, the side members 303 and 304 may be coupled to the frame 301 and the leading member 399. The lateral side portion 404 may represent a dimension, for example, a first dimension $D_1$ partially defined by the side members 303 and 304. The volume 390 (FIG. 3) is bounded on three sides by the leading member 399 and the side members 303 and 304, and the volume is therefore partially defined by $D_1$.

The embodiment shown in FIG. 5 may be formed by coupling extension members 503 and 504 (FIG. 5) to side members 303 and 304, and the side members 303 and 304 may be coupled to the frame 301 and the leading member 399 as in the previous example. Extension members 503 and 504 may extend the lateral side portion 404 to a second dimension $D_2$ relatively greater than $D_1$, thereby providing a relatively larger volume 390 within the leading end assembly 300. Many of the parts (e.g., the frame 301, the leading member 399, and the side members 303 and 304) assembled to form the different embodiments in FIG. 4 and FIG. 5 may be identical or substantially identical between embodiments, and the configuration of side members 303 and 304 and extension members 503 and 504 may be chosen based on the desired size of the volume 390.

Figure 6:
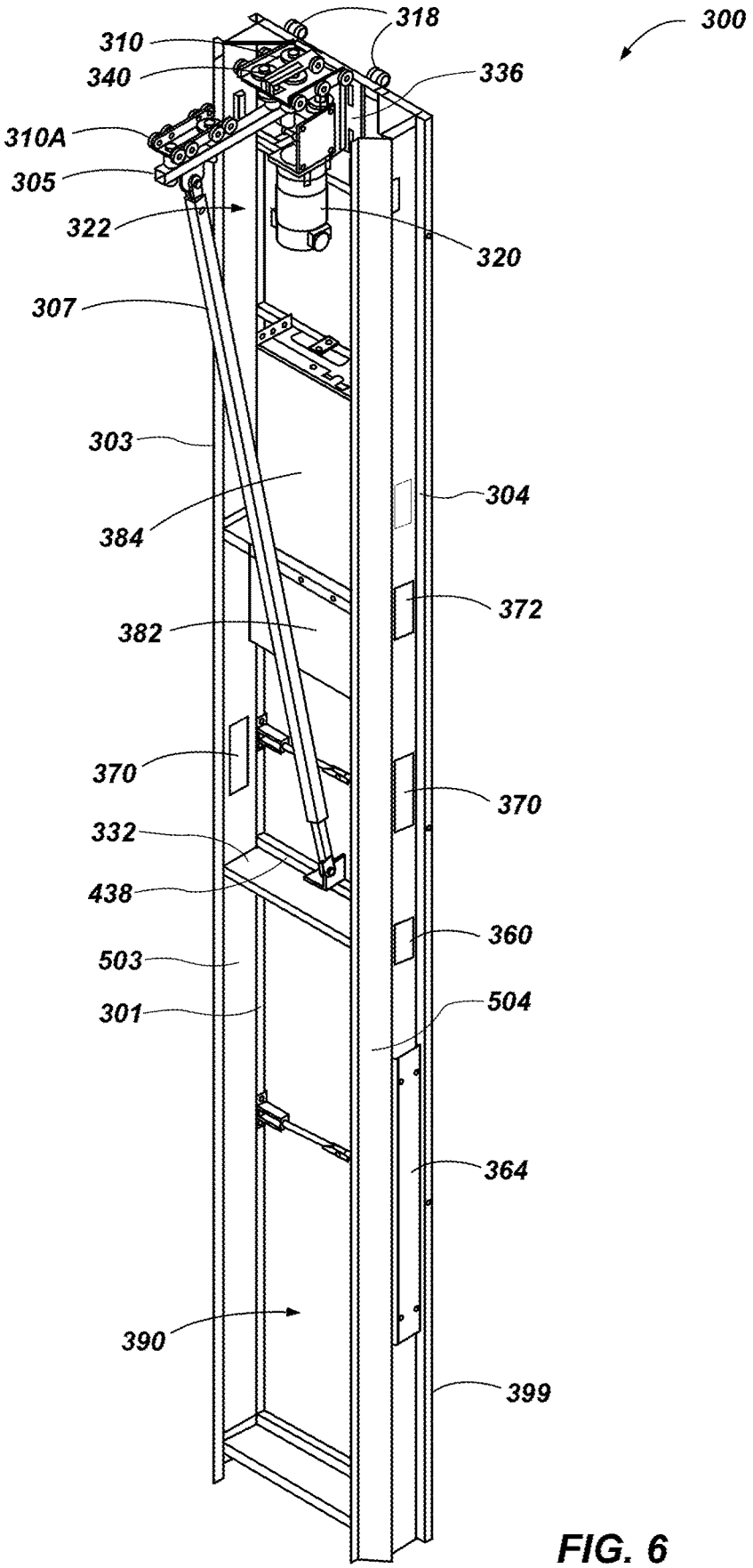
FIG. 6 is a perspective view of the leading end assembly of FIG. 5.

Referring now to FIG. 6, a leading end assembly 300 may include a drive assembly 322, a diagonal member 307, and a support member 305. Trolleys 310 and 310A may be connected to the support member 305. The drive assembly 322 may include a drive motor 320 connected to a rotatable drive element 340 such as a pinion gear or sprocket engaged with a fixed drive element such as a rack gear or a chain located in an overhead track (e.g., overhead track 112 shown in FIG. 1). The leading end assembly 300 may include a motor control module 384 with electrical and electronic components for controlling operation of the drive motor 320. A post control module 382 with electrical and electronic components for controlling other operations of the leading end assembly 300 is also illustrated. The leading end assembly 300 may also include box roller assemblies 318, which may be attached to the trolley 310, support member 305, diagonal member 307, frame 301, or combinations thereof. The box roller assemblies 318 may be configured for engaging with a channel or channels in the overhead track 112 (FIG. 1). A volume 390 may be configured to accept or partially cover (e.g., in unison with the accordion-style structures 120A and 120B (FIG. 2)) hardware items attached to the frame 301, such as a drive assembly 322, trolleys 310 and 310A, a diagonal support member 307, a support member 305, other hardware elements, and combinations thereof. The support member 305 may be configured to couple to trolleys 310 and 310A, the drive assembly 322, the diagonal support member 307, and other hardware. The support member 305 may also be coupled to the frame 301. In this embodiment, the leading end assembly 300 may include first and second side members 303 and 304 (as described above in relation to FIGS. 3 and 4) and may include extension members 503 and 504 coupled to one of the at least two side members 303 and 304, the frame 301, or both. A leading member 399, the side members 303 and 304, and the extension members 503 and 504 may cooperatively form the volume 390.

The leading end assembly 300 may also include structural supports 332 (e.g., support brackets) coupled with the frame 301. The structural supports 332 may extend from the frame 301 in a direction normal to the trailing surface 438 of the frame 301. The structural supports 332 and the frame 301 may be formed as one piece, or the structural supports 332 may be formed separately from the frame 301 and may be attached by welding, mechanical fasteners, or other methods. The structural supports 332 may be formed from the same material as the frame 301, may be formed from the same material as another portion of the leading end assembly 300 (e.g., the leading member 399, the side members 303 and 304, etc.), or may be formed from different materials. In some embodiments, the structural supports 332 may be coupled to the frame 301 and to the extension members 503 and 504. The structural supports 332 may be coupled to the extension members at one or more of the first portion 501 and second portion 502 as described in FIG. 5. In other embodiments, the structural supports 332 may also be coupled to the side members 303 and 304. The structural supports 332 may also be configured to couple with the accordion-style structures 120A and 120B of the movable partition 102 (FIG. 2).

The frame 301 may include attachment points for attaching hardware such as the drive assembly 322, the trolleys 310 and 310A, and the support member 305. The attachment points may include structures fastened to the frame 301 and configured to receive mechanical fasteners, for example, a mounting plate or angle 336 with holes or slots to accept bolts to attach the drive assembly 322. In other embodiments, the attachment points may include holes or slots in the frame 301. In yet other embodiments, the attachment points may include tabs or bosses formed integrally with, welded or bonded to, or otherwise fastened to the frame 301. In yet other embodiments, hardware such as the support member 305 may be attached directly to the frame 301 by methods such as welding, brazing, or adhesive materials.

Leading end assembly 300 may also include vision panels 370 (may also be referred to as light kits) included as a cutout or window on each of the side members 303 and 304 so that a person can see a region on the other side of the movable partition 102 (FIG. 1). For example, the vision panels 370 may be useful for verifying that is safe to operate the movable partition 102 based on what can be seen of the region on the other side. A door display 372 may be included to present various status messages to the user about operation of the leading end assembly 300, temperature or other environmental information on either side of the movable partition 102, or other information.

The leading end assembly 300 may also include an emergency actuator 364 (e.g., a switch), commonly referred to as "panic hardware," located on the side members 303 and 304 or extension members 503 and 504. Operation of the emergency actuator 364 allows a person to cause the door to retract, open, or open partially if it is closed, or to stop while it is closing, allowing access through the barrier formed by the movable partition 102 for a predetermined amount of time. Moreover, the movable partition system 100 (FIG. 1) may further include, or may be associated with, an alarm system which, upon providing an appropriate signal, results in deployment or retraction of the movable partition 102 depending on the specific situation.

Other user-controlled switches 360 may also be included on the side members 303 and 304 or extension members 503 and 504 such as, for example, a general operation switch and keyed switch. The keyed switch may be used by authorized persons such as facility managers or fire department personnel for controlling operation of the movable partition 102. The general operation switch may be used by any person for controlling operation of the movable partition 102. As non-limiting examples, the user-controlled switches 360 and the emergency actuator 364 may directly, or indirectly through electrical components modules, generate movement signals such as an open-or-close command, a stop-or-go command, or an emergency command.

In another aspect of the present disclosure, a method of forming a leading end assembly for a movable partition includes forming a frame member, coupling a leading member to the frame member, coupling two opposing side members to the frame member, forming a portion of each of the two opposing side members for coupling with a leading panel of a sheet of panels of a movable partition, coupling two opposing extension members extending from the two opposing side members to the frame member, and forming a portion of each of the two opposing extension members for coupling with a leading panel of a sheet of panels of a movable partition.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure includes all modifications, equivalents, legal equivalents, and alternatives falling within the spirit and scope of the disclosure as defined by the following appended claims.

What is claimed is:

1. A method of forming a leading end assembly for a movable partition, comprising:

coupling a leading member to a frame member;

coupling two opposing side members to the frame member;

coupling a first extension member of two opposing extension members to a first side member of the two opposing side members;

coupling a second extension member of the two opposing extension members to a second side member of the two opposing side members;

forming a coupling portion of the first extension member of the two opposing extension members for coupling with a first plurality of hingedly coupled panels of the movable partition such that the entirety of the first extension member and the entirety of the first plurality of hingedly coupled panels is positioned and configured to be suspended from an overhead track at a location directly behind the leading member in a direction along an intended direction of travel of the leading end assembly along the overhead track; and forming a coupling portion of the second extension member of the two opposing extension members for coupling with a second plurality of hingedly coupled panels of the movable partition such that the entirety of the second extension member and the entirety of the second plurality of hingedly coupled panels is positioned and configured to be suspended from the overhead track at the location directly behind the leading member in the direction along the intended direction of travel of the leading end assembly along the overhead track.

2. The method of claim 1, further comprising extending each of the two opposing extension members beyond each of the two opposing side members in a direction away from the frame member.

3. The method of claim 1, further comprising defining a foremost leading surface of the leading end assembly with a surface of the leading member.

4. The method of claim 1, further comprising defining the two opposing side members to be initially separate from the leading member and the frame member prior to the coupling of the two opposing side members to the frame member.

5. The method of claim 1, further comprising extending at least one roller assembly from the leading end assembly, the at least one roller assembly configured to suspend the leading end assembly from an overhead track.

6. The method of claim 1, further comprising defining a window in each of the first side member and the second side member of the two opposing side members, such that a person can see a region on another side of the moveable partition through the window in each of the first side member and the second side member of the two opposing side members.

7. The method of claim 1, further comprising providing an emergency actuator on at least one of the first side member, the second side member, the first extension member, and the second extension member.

8. The method of claim 1, further comprising coupling the coupling portion of the first extension member of the two opposing extension members with a leading panel of the first plurality of hingedly coupled panels of the movable partition and coupling the coupling portion of the second extension member of the two opposing extension members to a leading panel of the second plurality of hingedly coupled panels of the movable partition.

9. The method of claim 1, further comprising providing a keyed switch for controlling operation of the movable partition on at least one of the first side member, the second side member, the first extension member, and the second extension member.

10. The method of claim 1, further comprising defining a transition area of each of the first extension member and the second extension member of the two opposing extension members extending away from the frame member, the transition area extending at an oblique angle relative to a foremost face of the leading member along the intended direction of travel of the movable partition along the overhead track.

11. The method of claim 1, further comprising at least partially defining a volume within the leading end assembly.

12. The method of claim 11, further comprising sizing and configuring the volume to house a drive motor of the movable partition.

13. A method of forming a leading end assembly for a movable partition, comprising:

coupling a leading member to a frame member;

coupling two opposing side members to the frame member;

coupling two opposing extension members extending from and beyond the two opposing side members to the frame member; and coupling a portion of each of the two opposing extension members to a respective leading panel of two sheets of panels of the movable partition such that the entirety of the two sheets of panels is positioned and configured to be suspended from an overhead track at a location directly behind the leading member in a direction along an intended direction of travel of the leading end assembly along the overhead track.

14. The method of claim 13, further comprising at least partially defining a volume within the leading end assembly with the leading member and each of the two opposing extension members.

15. The method of claim 14, further comprising positioning at least a portion of a drive assembly comprising a drive motor connected to a rotatable drive element at least partially within the volume defined in the leading end assembly, the drive motor and the rotatable drive element configured to move the two sheets of panels and the leading end assembly along the overhead track.

16. The method of claim 13, further comprising defining a window in each of the two opposing side members, such that a person can see a region on another side of the moveable partition through the window in each of the two opposing side members.

17. The method of claim 13, further comprising providing an emergency actuator on at least one of the two opposing side members and the two opposing extension members.

18. A method of forming a movable partition, the method comprising:

defining a leading end assembly comprising:

directly coupling a leading member to a frame member;

defining at least a portion of a foremost leading surface of the leading end assembly and a movable partition with a surface of the leading member; and directly coupling two opposing side members to the frame member to define opposing lateral side portions of the leading end assembly;

coupling a first side member of the two opposing side members of the leading end assembly to a first plurality of hingedly coupled panels of the movable partition, such that the entirety of the first plurality of hingedly coupled panels is configured to be suspended from an overhead track at a location directly behind the leading member in a direction along an intended direction of travel of the leading end assembly along the overhead track; and coupling a second side member of the two opposing side members of the leading end assembly to a second plurality of hingedly coupled panels of the movable partition, such that the entirety of the second plurality of hingedly coupled panels is configured to be suspended from the overhead track at another location directly behind the leading member in the direction along the intended direction of travel of the leading end assembly along the overhead track.

19. The method of claim 18, further comprising defining the two opposing side members from separate pieces that are unattached to the leading member prior to the direct coupling of the two opposing side members to the frame member.

20. The method of claim 18, further comprising defining a window in each of the two opposing side members, such that a person can see a region on another side of the moveable partition through the window in each of the two opposing side members.

* * * * *